United States Patent [19]

Piber

[11] 4,187,420

[45] Feb. 5, 1980

[54] ROCKER SWITCH WITH SELECTIVE LOCKOUT MEANS SHIFTABLE TRANSVERSELY OF THE PIVOTAL AXIS

[75] Inventor: Earl T. Piber, Oconomowoc, Wis.

[73] Assignee: Eaton Corporation, Cleveland, Ohio

[21] Appl. No.: 906,875

[22] Filed: May 17, 1978

[51] Int. Cl.[2] ..... H01H 21/50; H01H 21/06

[52] U.S. Cl. ..... 200/321

[58] Field of Search ..... 200/321, 322, 325, 327, 200/318, 67 C, 68, 42 T

[56] References Cited

U.S. PATENT DOCUMENTS

| | | | |
|---|---|---|---|
| 1,398,580 | 11/1921 | Waite | 200/17 |
| 2,246,919 | 6/1941 | Krantz | 200/318 |
| 2,616,012 | 10/1952 | Gaynor | 200/322 |
| 2,789,170 | 4/1957 | Johnson | 200/321 |
| 3,225,153 | 12/1965 | Carling | 200/676 |
| 3,246,087 | 4/1966 | Haviland | 200/676 |
| 3,329,789 | 7/1967 | Sahrbacker | 200/157 |
| 3,376,400 | 4/1968 | Batt et al. | 200/42 T |
| 3,959,609 | 5/1976 | Laing et al. | 200/322 |
| 4,002,874 | 1/1977 | Brown | 200/321 |
| 4,013,858 | 3/1977 | Grebner et al. | 200/321 |

FOREIGN PATENT DOCUMENTS

| | | | |
|---|---|---|---|
| 1076787 | 3/1960 | Fed. Rep. of Germany | 200/321 |
| 1947014 | 3/1971 | Fed. Rep. of Germany | 200/321 |

*Primary Examiner*—John W. Shepperd

*Attorney, Agent, or Firm*—Hugh R. Rather; William A. Autio

[57] ABSTRACT

A latching attachment for rocker switches is disclosed which is manually shiftable to selectively allow depression of only one or the other end of the rocker button. The attachment includes an elongated slider member disposed alongside the rocker button and slidable transversely of the pivotal axis. At the distal ends of the attachment there are extended lower interference ear portions which, upon shifting of the attachment, alternately protrude below, and into the path of motion of, a respective end of the rocker button to prevent depression thereof.

19 Claims, 4 Drawing Figures

ROCKER SWITCH WITH SELECTIVE LOCKOUT MEANS SHIFTABLE TRANSVERSELY OF THE PIVOTAL AXIS

BACKGROUND OF THE INVENTION

Selective lockout means for rocker switches are known in the art, for example as shown in H. W. Brown U.S. Pat. No. 4,002,874.

SUMMARY OF THE INVENTION

An object of the invention is to provide selective lockout means for rocker switches.

Another object is to provide an add-on attachment for rocker switches which enables a selective lockout function without altering the existing structure of the rocker switch.

Other objects and advantages will hereinafter appear.

DESCRIPTION OF THE PREFERRED EMBODIMENT

Figure 1:
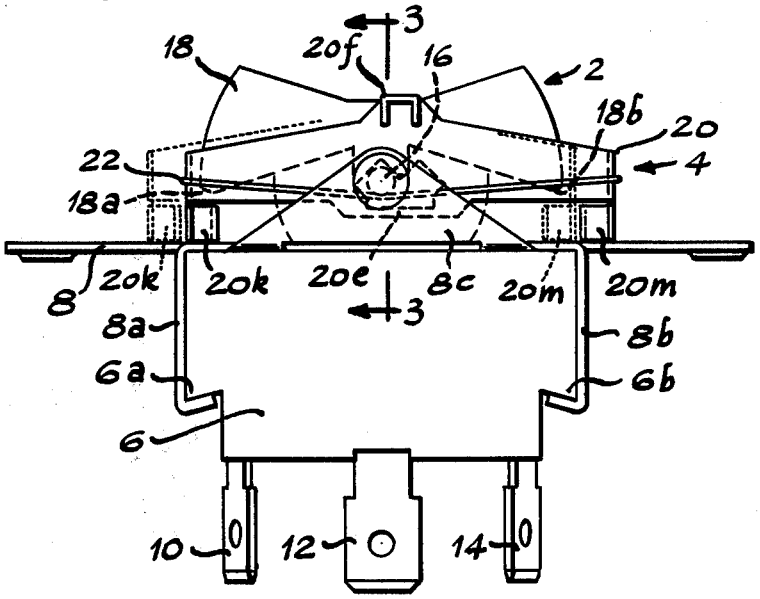
FIG. 1 is a front elevational view of a rocker switch 2 with selective lockout means 4 constructed in accordance with the invention, and showing the alternate shifted position of the lockout means in dashed line.

There is shown in FIG. 1 a rocker switch, generally designated 2, with an add-on attachment, generally designated 4, providing selective lockout.

The rocker switch comprises an open-topped housing 6 closed by a cover plate bezel 8 secured to the housing by arms 8*a* and 8*b* extending downwardly along the sides of the housing and crimped under appropriately formed shoulders 6*a* and 6*b*. Externally extending terminals 10, 12 and 14 are connected to contact means within the housing, such as the contact means shown in said H. W. Brown U.S. Pat. No. 4,002,874, hereby incorporated herein by reference. The cover plate bezel has front and rear upstanding triangular shaped support portions 8*c* and 8*d* mounting a shaft 16 extending therebetween. A rocker operator 18 is mounted to shaft 16 for pivotal movement about the axis thereof, and has a portion extending through an opening in the bezel cover plate interiorly of the housing for actuating said contact means therein in response to rocking of the operator, for example as shown in said Brown Patent. In the particular embodiment shown, the rocker button has a central OFF position, in addition to a clockwise tilted ON position completing a circuit between terminals 10 and 12, and a counterclockwise tilted ON position completing a circuit between terminals 14 and 12, though this is not a constraint of the invention.

Selective lockout means 4 is an add-on attachment comprising slider member 20 and spring 22 which enable selective lockout without altering the structure of the rocker switch. Slider member 20 is an elongated formed part disposed, FIG. 2, between support portion 8*c* and the rocker button. Slider member 20 has a central lower aperture 20*a*, FIG. 4, with an inverted apex point 20*b* separating a pair of indexing detent slots 20*c* and 20*d* for receiving shaft 16. The bottom wall of the aperture is formed by a lower lip portion 20*e* of the slider member for added strength and rigidity. An elongated wire spring 22 extends along the frontside of support 8*c*, FIG. 2, and beneath shaft 16, FIG. 3. The ends of the spring are curled back and mounted in holes in the turned ends 20*g* and 20*h* of the slider member, FIG. 4. The central part of the spring bears against the underside of shaft 16 and pulls slider member 20 downwardly such that shaft 16 is in biased engagement with respective indexing detent slot 20*c* or 20*d*, depending on selected position of the slider member.

Figure 4:
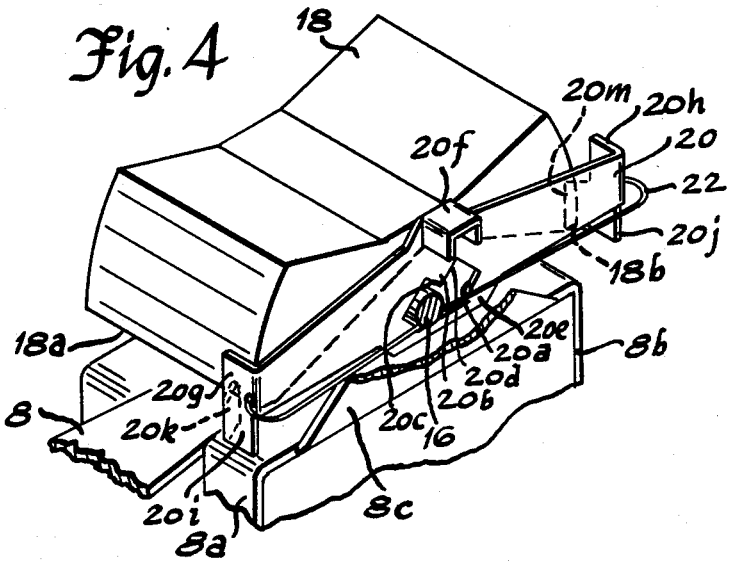
FIG. 4 is a partial isometric view of the switch of FIGS. 1-3, with front pivot support 8*c* broken away.

The slider member has a manually engageable handle portion 20*f* for shifting the slider member left or right transversely of the pivotal axis 16 of the rocker button. FIGS. 1 and 4 show the slider member shifted rightward with shaft 16 in slot 20*c*, whereby the slider member is in an indexed positive-feel stable position. Upon leftward shifting, the slider member rises slightly against the bias of spring 22 as apex 20*b* crosses over shaft 16, whereafter slot 20*d* slides onto shaft 16 with a positive indexing feel, and the slider member is in the leftward position shown in dashed line in FIG. 1.

The left- and rightmost ends 20*g* and 20*h* of the slider member extend beyond the rocker button, and are turned inwardly 90°, FIG. 4. These ends have lower segments 20*i* and 20*j*, FIG. 4, which extend downwardly below the main body of slider member 20. Lower segments 20*i* and 20*j* have ear portions 20*k* and 20*m* turned back 45° towards shaft 16 to act as interference members for preventing depression of the rocker button 18 to a designated condition depending on the selected position of slider member 20.

Figure 2:
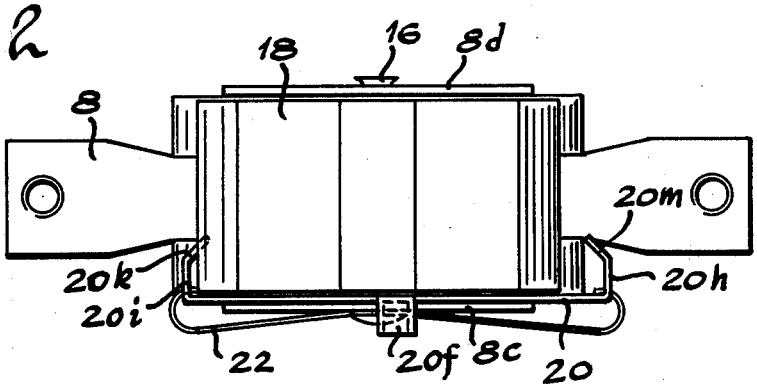
FIG. 2 is a top view of the switch of FIG. 1.
Figure 3:
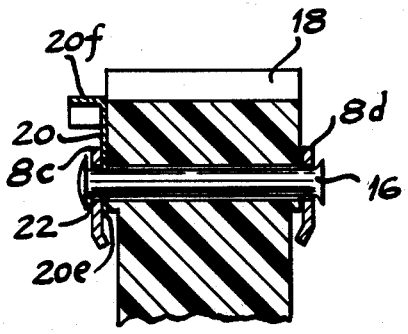
FIG. 3 is a cross-sectional view taken along line 3—3 of FIG. 1.

When the slider member 20 is in the rightward shifted position shown in FIGS. 1, 2 and 4, interference ear portion 20*k* is disposed below and in the path of motion of the left lower edge 18*a* of the rocker button to thus prevent pivoting of the latter to its counterclockwise tilted position, whereby to prevent completion of a circuit between terminals 14 and 12. The right side of the rocker button may be depressed because interference ear portion 20*m* is disposed rightwardly of and out of the path of motion of right lower edge 18*b* of the rocker button, thus allowing pivoting of the latter to its clockwise tilted position, whereby to permit completion of a circuit between terminals 10 and 12.

When the slider member 20 is shifted to its leftward position, shown in dashed line in FIG. 1, the right side of the rocker button cannot be depressed because interference ear portion 20*m* now lies in the path of motion of lower right edge 18*b* of the rocker button. The left side of the rocker button can be depressed because interference ear portion 20*k* no longer lies in the path of motion of lower left edge 18*a*.

It is recognized that various modifications are possible within the scope of the appended claims.

I claim:

1. A rocker switch with selective lockout means comprising:

a switch housing;

contact means mounted in said housing;

a rocker button pivotally mounted to said housing for actuating said contact means, said rocker button having a designated tilted position corresponding to a designated condition of said contact means; and selective lockout means including mounting means therefor rendering the same shiftable transversely of the pivotal axis of said rocker button to a designated selective position for preventing rocking of said rocker button to said designated tilted position and thus lockout said designated condition of said contact means, said selective lockout means comprising a slider member having an interference ear portion protruding into the path of motion of said rocker button when said slider member is in said designated selective position, wherein said rocker button is pivotally mounted to said housing by means of a shaft, and wherein said mounting means comprises resilient means biasing said slider member into engagement with said shaft.

2. A rocker switch with selective lockout means comprising:

a switch housing;

contact means within said housing;

a rocker button pivotally mounted to said housing and having a portion extending internally thereof for actuating said contact means, said rocker button having a clockwise tilted position and a counterclockwise tilted position about the pivotal axis thereof; and selective lockout means including mounting means therefor rendering the same shiftable transversely of said pivotal axis into one or another selective position for limiting rocking movement of said rocker button to one or the other of said tilted positions as determined by the selective position of said lockout means, wherein said lockout means comprises an elongated slider member extending transversely of said pivotal axis and adjacent said rocker button, said slider member having interference ear portions proximate the ends thereof alternately protruding below and into the path of motion of the undersides of respective ends of said rocker button as determined by the selective position of said slider member, and wherein said slider member is external of said housing and said interference ear portions abut a top wall of said housing.

3. The invention according to claim 2 wherein said slider member has turned ends and said interference ear portions are turned inwardly from said turned ends toward said pivotal axis.

4. A rocker switch with selective lockout means comprising:

a switch housing;

contact means within said housing;

a rocker button pivotally mounted to said housing and having a portion extending internally thereof for actuating said contact means, said rocker button having a clockwise tilted position and a counterclockwise tilted position about the pivotal axis thereof; and selective lockout means including mounting means therefor rendering the same shiftable transversely of said pivotal axis into one or another selective position for limiting rocking movement of said rocker button to one or the other of said tilted positions as determined by the selective position of said lockout means, wherein said lockout means comprises an elongated slider member extending transversely of said pivotal axis and adjacent said rocker button, said slider member having interference ear portions proximate the ends thereof alternately protruding below and into the path of motion of the undersides of respective ends of said rocker button as determined by the selective position of said slider member, and wherein said rocker button is mounted to said housing by means of a shaft forming said pivotal axis and wherein said mounting means comprises resilient means biasing said slider member into engagement with said shaft.

5. The invention according to claim 4 wherein said slider member has a pair of indexing detent slots alternately receiving said shaft in biased indexed stable positive-feel condition as determined by the selective position of said slider member.

6. The invention according to claim 5 wherein said resilient means comprises a wire spring attached at its ends to said slider member and bearing at its middle against one side of said shaft, and wherein said detent slots engage the other side of said shaft.

7. The invention according to claim 5 wherein said detent slots are separated by an apex which slides transversely across said shaft causing lateral displacement of said slider member against the bias of said resilient means, said lateral displacement being orthogonal to said pivotal axis and said transverse shifting of said slider member.

8. The invention according to claim 7 wherein said detent slots are formed by an aperture through said slider member.

9. The invention according to claim 4 wherein said housing has a pair of front and rear upstanding supports mounting said shaft therebetween, said slider member being disposed between said rocker button and said front support.

10. The invention according to claim 9 wherein said slider member engages said shaft from above, and wherein said resilient means comprises a wire spring attached at its ends to said slider member and extending in front of said front support to bear against the underside of said shaft.

11. The invention according to claim 9 wherein said slider member has a manually engageable handle portion extending forwardly from the center thereof above said front support.

12. A rocker switch with selective lockout means comprising:

a switch housing;

contact means within said housing;

a rocker button pivotally mounted to said housing and having a portion extending internally thereof for actuating said contact means, said rocker button having a clockwise tilted position and a counterclockwise tilted position about the pivotal axis thereof; and selective lockout means comprising a slider member and mounting means therefor rendering said slider member shiftable transversely of said pivotal axis to a designated selective position, said slider member having an interference ear portion protruding below and into the path of motion of the right underside of said rocker button when said slider member is shifted to said designated selective position whereby to prevent rocking of said rocker button to said clockwise tilted position, wherein said interference ear portion abuts the topside of a top wall of said housing, and wherein said rocker button is pivotally mounted to said housing by means of a shaft, and wherein said mounting means comprises resilient means biasing said slider member into engagement with said shaft.

13. The invention according to claim 12 wherein said slider member has an indexing detent slot receiving said shaft when said slider member is in said designated selective position to provide a positive-feel stable indexed condition of said slider member.

14. A rocker switch with selective lockout means comprising:

a switch housing;

contact means within said housing, a rocker button pivotally mounted to said housing for rocking movement between a clockwise tilted position and a counterclockwise tilted position, and having a portion extending internally of said housing for actuating said contact means; and selective lockout means comprising a slider member and mounting means therefor rendering said slider member shiftable transversely of the pivotal axis of said rocker button to a right or a left selective position, said slider member having right and left interference ear portions alternately protruding below and into the path of motion of the undersides of said rocker button as determined by the selective position of said slider member;

such that when said slider member is shifted to said right selective position, said left interference ear portion protrudes below the left underside of said rocker button to prevent rocking of said rocker button to said counterclockwise tilted position; and such that when said slider member is shifted to said left selective position, said right interference ear portion protrudes below the right underside of said rocker button to prevent rocking of said rocker button to said clockwise tilted position, wherein:

said rocker button is pivotally mounted to said housing by means of a shaft;

said mounting means comprises resilient means biasing said slider member into engagement with said shaft; and said slider member has right and left indexing detent slots alternately receiving said shaft in biased indexed stable positive-feel condition for each said right and left selective position;

such that when said slider member is shifted to said right selective position, said left indexing detent slot engages said shaft and said left interference ear portion protrudes below said left underside of said rocker button to prevent rocking of said rocker button to said counterclockwise tilted position; and such that when said slider member is shifted to said left selective position, said right indexing detent slot engages said shaft and said right interference ear portion protrudes below said right underside of said rocker button to prevent rocking of said rocker button to said clockwise tilted position.

15. The invention according to claim 14 wherein said housing has a top wall with an aperture therein through which said portion of said rocker button extends downwardly internally of said housing, and wherein said housing has front and rear supports extending upwardly from said top wall, said shaft being mounted to said supports and extending therebetween, said slider member being an elongated member extending transversely of said pivotal axis and disposed between said front support and said rocker button and engaging the top of said shaft, said resilient means comprising a wire spring mounted at its ends to said slider member on opposite sides of said shaft and passing beneath said shaft to bear against the bottom thereof and pull said slider member downwardly against said shaft.

16. The invention according to claim 15 wherein said wire spring passes in front of said front support.

17. The invention according to claim 15 wherein said interference ear portions abut said top housing wall.

18. The invention according to claim 17 wherein said slider member has a main body portion and right and left end portions which are bent rearwardly from said main body portion and have a lower extension below said main body portion, and wherein said interference ear portions extend from said lower extensions and are bent inwardly toward said pivotal axis.

19. The invention according to claim 14 wherein said left and right indexing detent slots are separated by an apex which slides transversely across said shaft causing lateral displacement of said slider member against the bias of said resilient means, said lateral displacement being orthogonal to said pivotal axis and said transverse shifting of said slider member.

* * * * *